US005803368A

United States Patent [19]

Shekalim

[11] Patent Number: 5,803,368

[45] Date of Patent: Sep. 8, 1998

[54] AERATOR FOR WATER TAPS

[75] Inventor: Avraham Shekalim, Nesher, Israel

[73] Assignee: Agroteam Consultants Ltd., Migdal Haemek, Israel

[21] Appl. No.: 579,992

[22] Filed: Dec. 28, 1995

[30] Foreign Application Priority Data

Dec. 29, 1994 [IL] Israel ..... 112194
Nov. 27, 1995 [IL] Israel ..... 116151

[51] Int. Cl.[6] ..... E03C 1/08

[52] U.S. Cl. ..... 239/428.5

[58] Field of Search ..... 239/428.5, 553, 239/533, 553.5, 590, 590.3, 590.5

[56] References Cited

U.S. PATENT DOCUMENTS 797,273 7/1905 Barker .
2,998,931 9/1961 Aghnides ..... 239/428.5
2,998,933 9/1961 Aghnides .
3,537,651 11/1970 Classen ..... 239/428.5
3,554,451 1/1971 Aghnides ..... 239/428.5
3,630,455 12/1971 Parkison ..... 239/590.3
3,682,392 8/1972 Kint ..... 239/428.5
3,730,440 5/1973 Parkison ..... 239/590.5
4,000,857 1/1977 Moen .
4,534,513 8/1985 Aghnides ..... 239/428.5
4,637,552 1/1987 Finkbeiner et al. .
5,114,072 5/1992 Barhydt, Sr. .

FOREIGN PATENT DOCUMENTS 95630135 4/1996 European Pat. Off. .
2637252 4/1978 Germany .

*Primary Examiner*—Andres Kashnikow
*Assistant Examiner*—Steven J. Ganey
*Attorney, Agent, or Firm*—Benjamin J. Barish

[57] ABSTRACT

An aerator for attachment to a water tap includes a labyrinth device having a plurality of labyrinth passageways leading from its inlet face to its outlet face for reducing the pressure of the water before fed to a water-air mixing chamber.

16 Claims, 7 Drawing Sheets

FIG.11
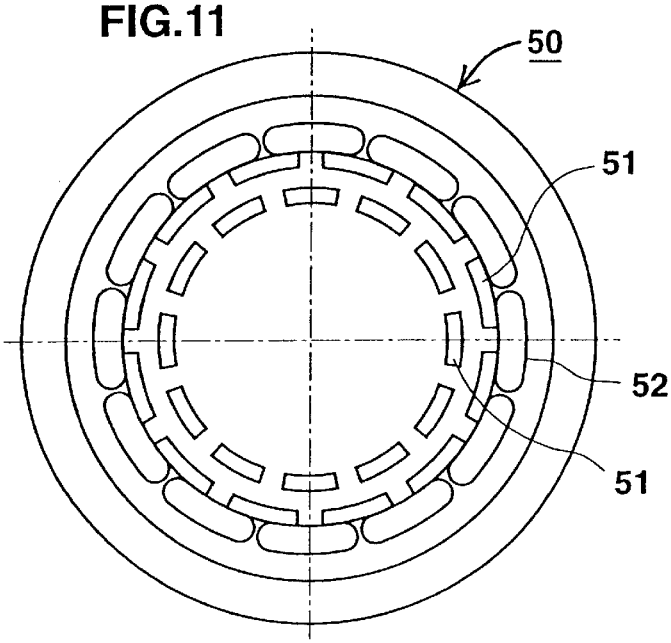
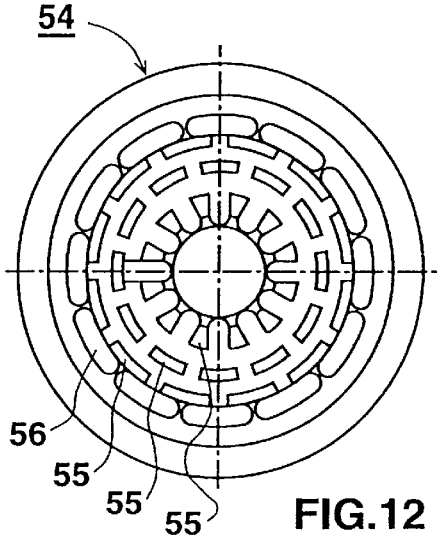
FIG.12
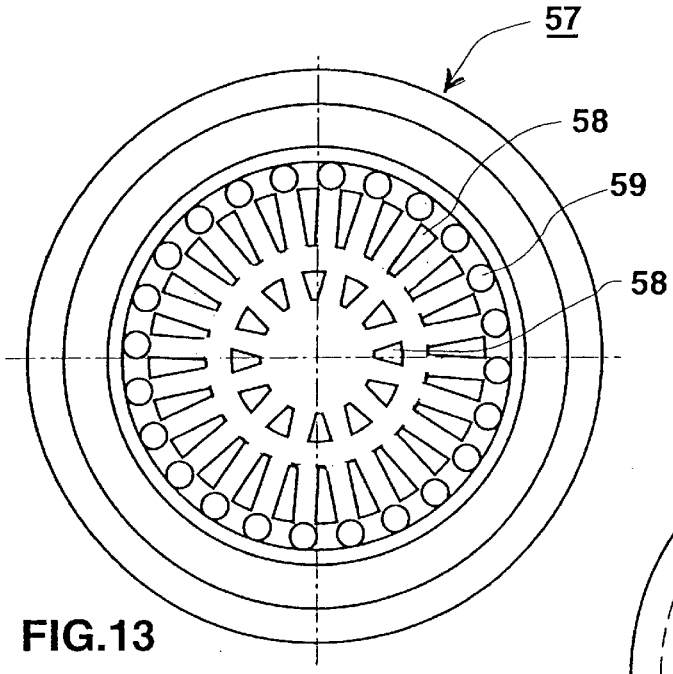
FIG.13
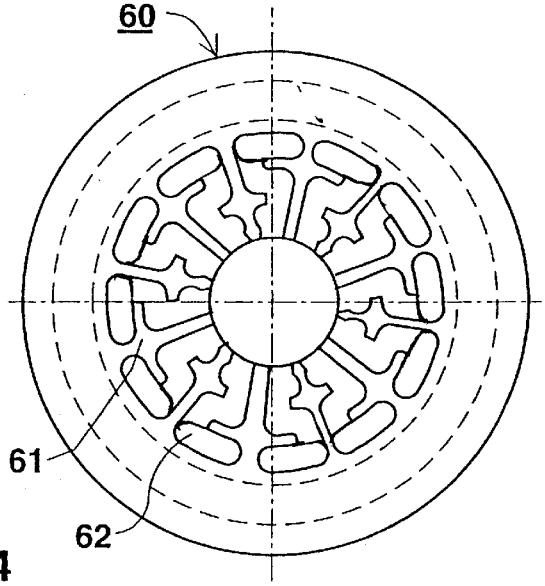
FIG.14

FIG.17
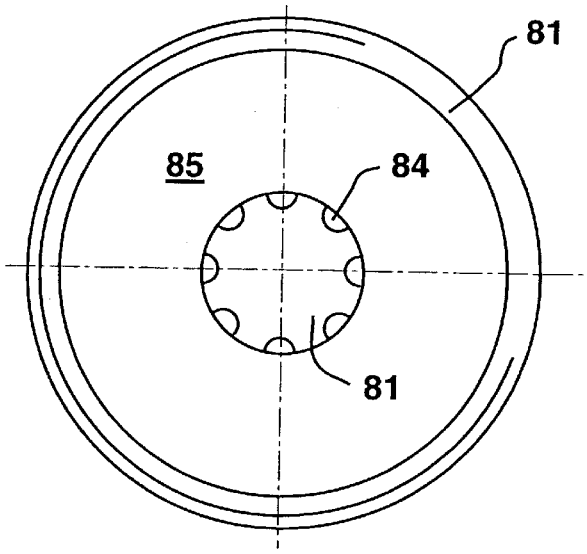
FIG.18
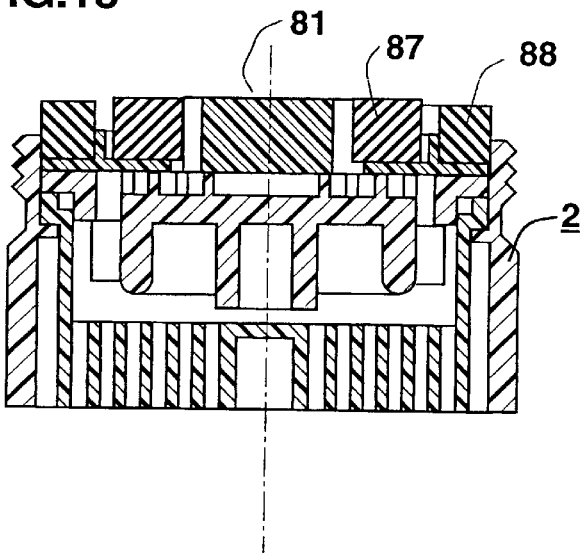
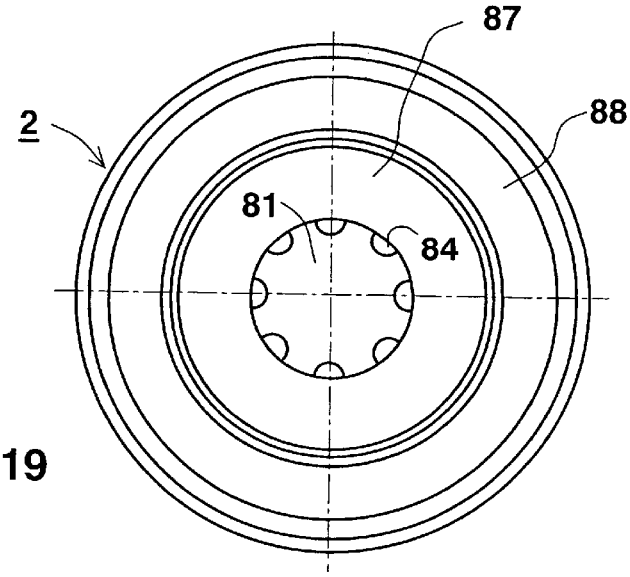
FIG.19

FIG.20
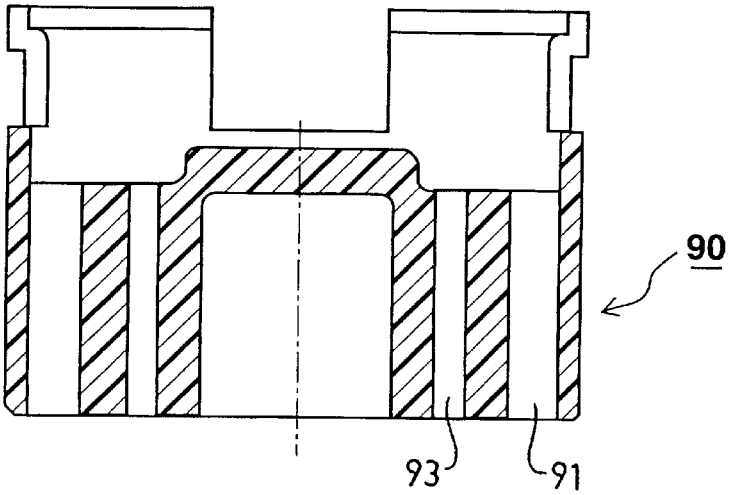
FIG.21
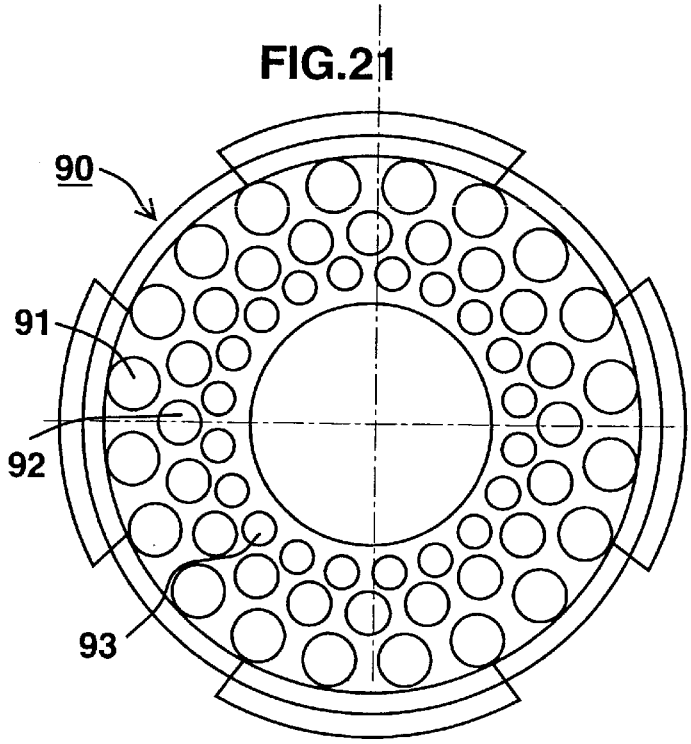
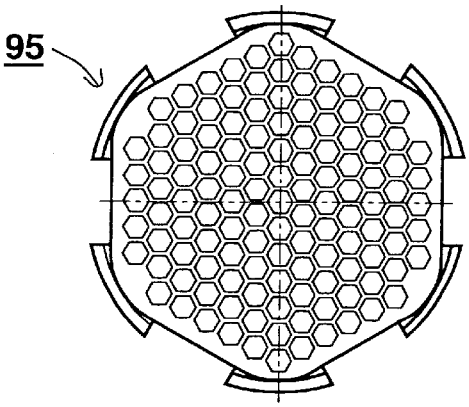
FIG.22

AERATOR FOR WATER TAPS

FIELD AND BACKGROUND OF THE INVENTION

The present invention relates to an aerator for attachment to a water tap or faucet in order to aerate the water discharged from the tap.

The conventional aerators now in use generally include a construction producing a low pressure area within the housing for drawing air into the housing and a metal screen for mixing the air in the water before the water is discharged from the tap. The metal screens used in such aerators, however, are relatively expensive to produce and generally require frequent cleaning. One aerator that eliminates such a screen is described in U.S. Pat. No. 4,637,552, but the construction described therein, which includes a plurality of staircase structures effecting the air-water mixing by impacting the water against solid surfaces, is quite complicated.

OBJECTS AND BRIEF SUMMARY OF THE INVENTION

According to the present invention, there is provided an aerator for attachment to a water tap, comprising: a housing having an inlet attachable to the water tap for receiving water therefrom, and an outlet through which the water is discharged; and a labyrinth device carried by the housing and having an inlet face facing the housing inlet, an outlet face facing the housing outlet, and a plurality of labyrinth passageways leading from the inlet face to the outlet face for reducing the water pressure at the outlet face of the labyrinth device. Each of the plurality of labyrinth passageways includes a radial flowpath extending in the radial direction of the housing for a major part of the length of the respective passageway, and an axial flowpath directly connected to the radial flowpath in the respective passageway and extending in the axial direction of the housing for a minor part of the length of the respective passgeway. The aerator further includes a water-air mixing chamber at the outlet face of the labyrinth device; and an air passageway leading from externally of the housing to the mixing chamber for drawing air into the mixing chamber for mixing with the water therein.

According to further features in the described preferred embodiments, the labyrinth device includes a disc; the radial flowpaths extend radially from a first area on the inlet face of the disc facing the housing inlet to a second area thereon; and the axial flowpaths extend axially through the disc at the second area thereof to the outlet face of the disc. Such a construction produces pressure-dropping passageways extending generally radially of the aerator for a major part of their lengths, rather than axially thereof, thereby enabling a much more compact structure to be attained.

According to a further important feature in the described preferred embodiments, the labyrinth passageways leading to the outlet face of the labyrinth member include surfaces which are slanted inwardly towards the center of the labyrinth member to direct the water inwardly towards the center of the mixing chamber. Such an arrangement enhances the pressure-drop produced in these passageways, thereby drawing more air into the water-air mixing chamber. It also produces water-water impacts in the mixing chamber, thereby enhancing the mixing therein.

In accordance with a further important feature in the described preferred embodiments, the labyrinth member includes a closure disc having an inlet face facing the housing inlet and formed with a circular array of passageways therethrough leading into the labyrinth passageways.

An elastomeric ring is included over the inlet face of the closure disc and is deformable such as to restrict the inlet passageways with increasing water inlet pressure, thereby providing a degree of pressure regulation, in response to variations in the inlet pressure.

In all the described embodiments, the labyrinth member may be made of plastic material and may therefore be produced in quantity at low cost, thereby decreasing the overall cost of the aerator. In addition, the labyrinth passageways in such an aerator may be of relatively large cross-section, thereby reducing the possibility of clogging and the need for frequent cleaning.

Further features and advantages of the invention will be apparent from the description below.

BRIEF DESCRIPTION OF THE DRAWINGS

The invention is herein described, by way of example only, with reference to the accompanying drawings, wherein:

FIGS. 11–14 are plan views illustrating four other forms of labyrinth discs that may be used;

FIG. 17 is a plan view of the aerator of FIG. 16;

FIG. 18 is a sectional view illustrating a still further form of aerator constructed in accordance with the present invention;

FIG. 19 is a plan view of the aerator of FIG. 18;

FIG. 20 is a sectional view illustrating another form of water guide member that may be used in any of the above-illustrated aerators;

FIG. 21 is a plan view of the water guide member of FIG. 20; and

FIG. 22 is a plan view illustrating another form of water guide member that may be used in any of the above-illustrated aerators of the present invention.

DESCRIPTION OF PREFERRED EMBODIMENTS

Figure 1:
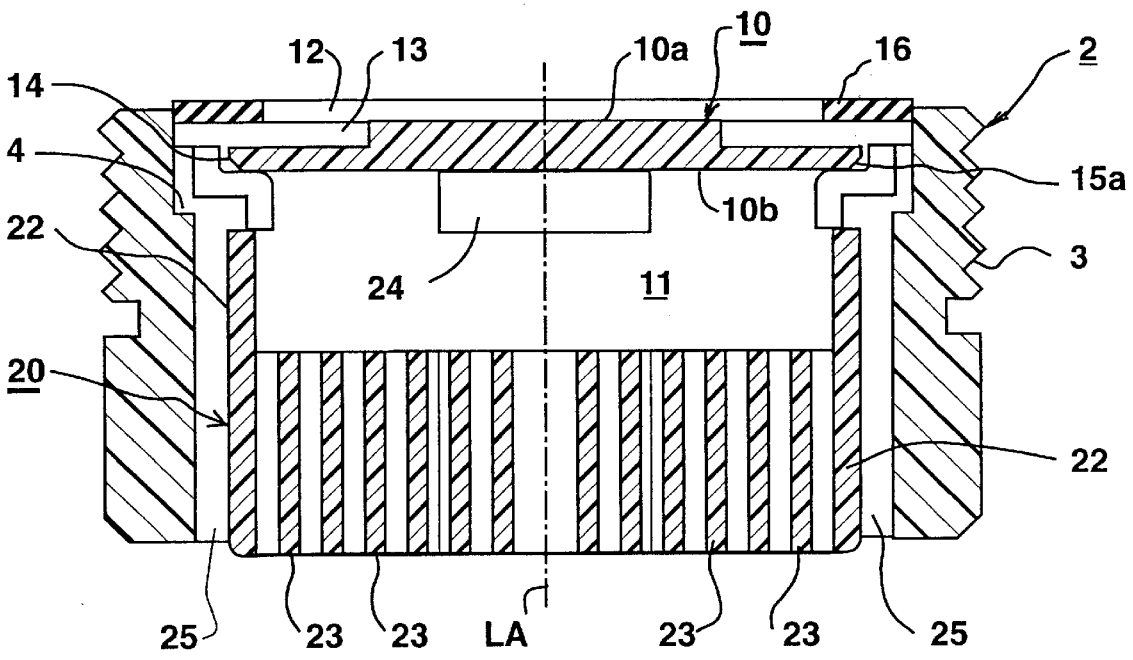
FIG. 1 is a longitudinal sectional view illustrating one form of aerator constructed in accordance with the present invention.

The aerator illustrated in FIGS. 1–5 includes a housing 2 formed with external threads 3 for attaching it to the spout of a water tap or faucet. Housing 2 is formed with an inner annular seat 4 for mounting two members within the housing, as will be described below, when the housing is attached to the spout of a water tap.

One of the members mounted within housing 3 is a labyrinth disc 10. Disc 10 has an inlet face 10*a* facing the housing inlet attached to the spout of the water tap (not shown), and an outlet face 10*b* facing and communicating with the housing outlet via a water-air mixing chamber 11. The inlet face 10*a* of labyrinth disc 10 is formed with a non-flat surface formation defining a plurality of labyrinth passageways leading from the inlet face 10*a* of the disc to the outlet face 10*b* for reducing the water pressure at the outlet face, and thereby in the water-air mixing chamber 11.

Figure 2:
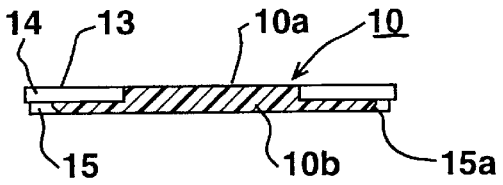
FIGS. 2 and 3 are sectional and plan views, respectively, of the labyrinth disc in the aerator of FIG. 1.
Figure 4:
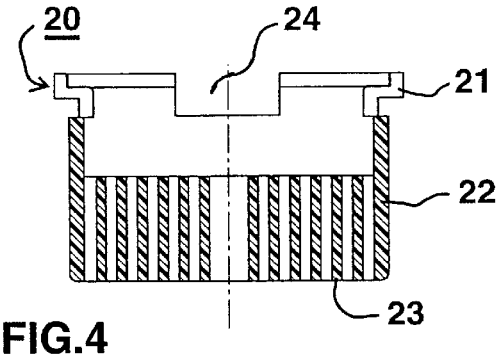
FIGS. 4 and 5 are sectional and plan views, respectively, of the water guide member included in the aerator of FIG. 1.
Figure 3:
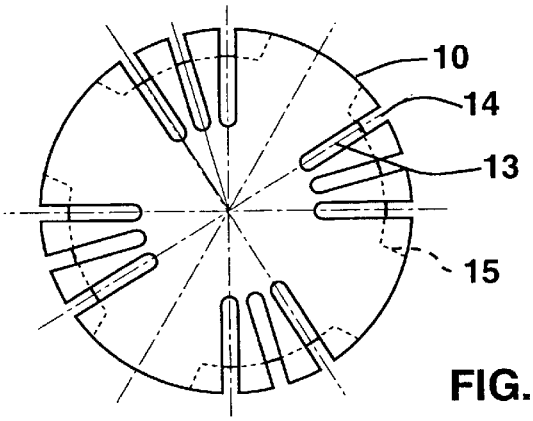
Figure 5:
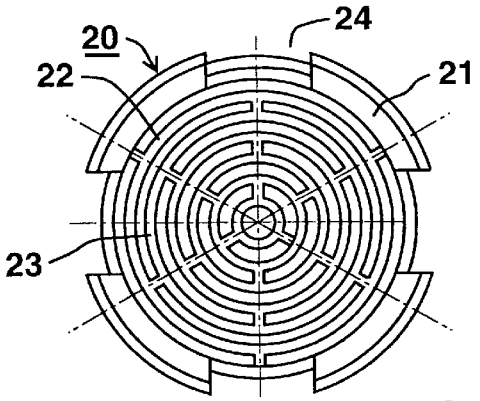

As shown particularly in FIGS. 2 and 3, the labyrinth passageways in the labyrinth disc 10 are in the form of four groups of three straight radial recesses 13 in the inlet face 10*a* of disc 10 communicating with a plurality of through slots 14 formed in the outer edge of the disc. Thus, the outlet face 10*b* of the disc is formed with a circumferential recess 15 for each of the four groups of radial recesses 13, with each recess 15 being of a depth equal to the thickness of the disc less the depth of the radial recesses 13, such that the intersection of the two recesses 13 and 15 produces a slot 14 for each recess 13 through the complete thickness of the disc. A rubber O-ring 16 overlies the outer periphery of the labyrinth 10, thereby constraining the water to flow via the radial passageways defined by the radial recesses 13 to slots 14 to the opposite face of the disc. O-ring 16 also serves as an annular seal when the aerator is attached by housing threads 3 to the water tap spout (not shown).

The inner surface of each recess 15 is slanted inwardly towards the center of disc 10, as shown at 15*a* in FIGS. 1 and 2, to direct the water inwardly towards the center of the mixing chamber 11.

The second member secured within housing 3 is a water guide assembly, generally designated 20, mounted on the housing annular seat 4. Water guide assembly 20 is integrally formed with an upper rim 21 for mounting the assembly on seat 4, an outer cylindrical tube 22 received within housing 2 but of smaller diameter than the housing, and a plurality of concentric tubes 23 within the outer tube 22. Rim 21 is interrupted to define a plurality (four) rectangular passageways 24. The annular space 25 between the outer face of the outer tube 22 and the inner face of housing 2 serves as an air passageway for drawing air into the aerator via passageways 24 into the mixing chamber 11 of the aerator.

When the illustrated aerator is attached to the water spout, it operates as follows:

The water discharged from the water spout first impinges the central region of face 10*a* of the labyrinth disc 10 and flows via the radial recesses 13, defining labyrinth passageways, to the throughgoing slots 14 formed in the outer edge of the disc and into the mixing chamber 11 at the opposite face 10*b* of the disc. Labyrinth disc 10 thus serves as a water-splitting, pressure-reducing member splitting the inletted water into a plurality of streams of reduced pressure as they flow into the mixing chamber 11, thereby producing a low pressure within the mixing chamber. This low pressure draws air via the annular passageway 25 between housing 2 and the water guide assembly 20, and via passageways 24 in the upper end of the water guide assembly, into the mixing chamber 11 where the air is mixed with the water entering that chamber via the above-described labyrinth passageways. The water-air mixture formed in chamber 11 is outletted via the spaces between the concentric tubes 23 of the water guide assembly 20, so that the water is discharged in the form of a plurality of annular streams of soft aerated water parallel to the longitudinal axis LA of the aerator.

It will thus be seen that the illustrated aerator can be constructed of a few relatively simple parts which can be produced in volume and at low cost. In addition, the passageways are relatively large so that there is less chance of clogging and less frequent need of cleaning, as compared for example to the conventional aerators utilizing metal screens. The inwardly-slanted surfaces 15*a* in the recesses 15 directs the water inwardly towards the center of the mixing chamber 11, and thereby further lower the pressure within the mixing chamber to draw air into it, and also produce a water-water inpact which enhances the air-water mixing in chamber 11. Further, since each labyrinth passageway includes a radial flowpath (recesses 13) extending in the radial direction of the housing for a major part of the length of the passageway, and an axial flowpath (slots 14) extending in the axial direction of the housing for a minor part of the length of the passageway, the aerator may be constructed very compactly.

Figure 6:
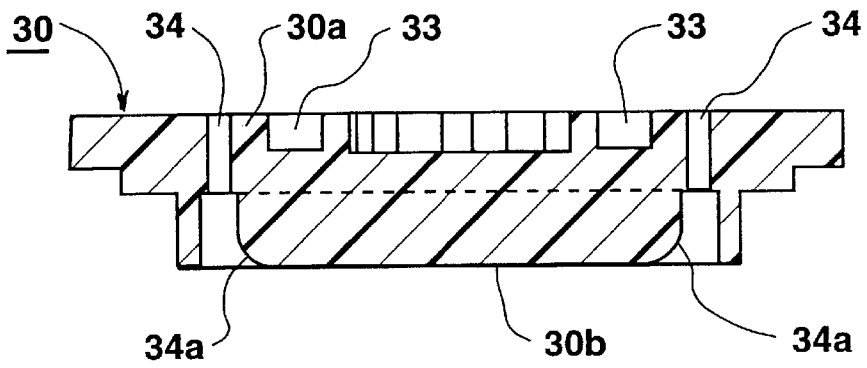
FIGS. 6 and 7 are views corresponding to those of FIGS. 2 and 3, respectively, illustrating another form of labyrinth disc that may be used in the aerator of FIG. 1.
Figure 7:
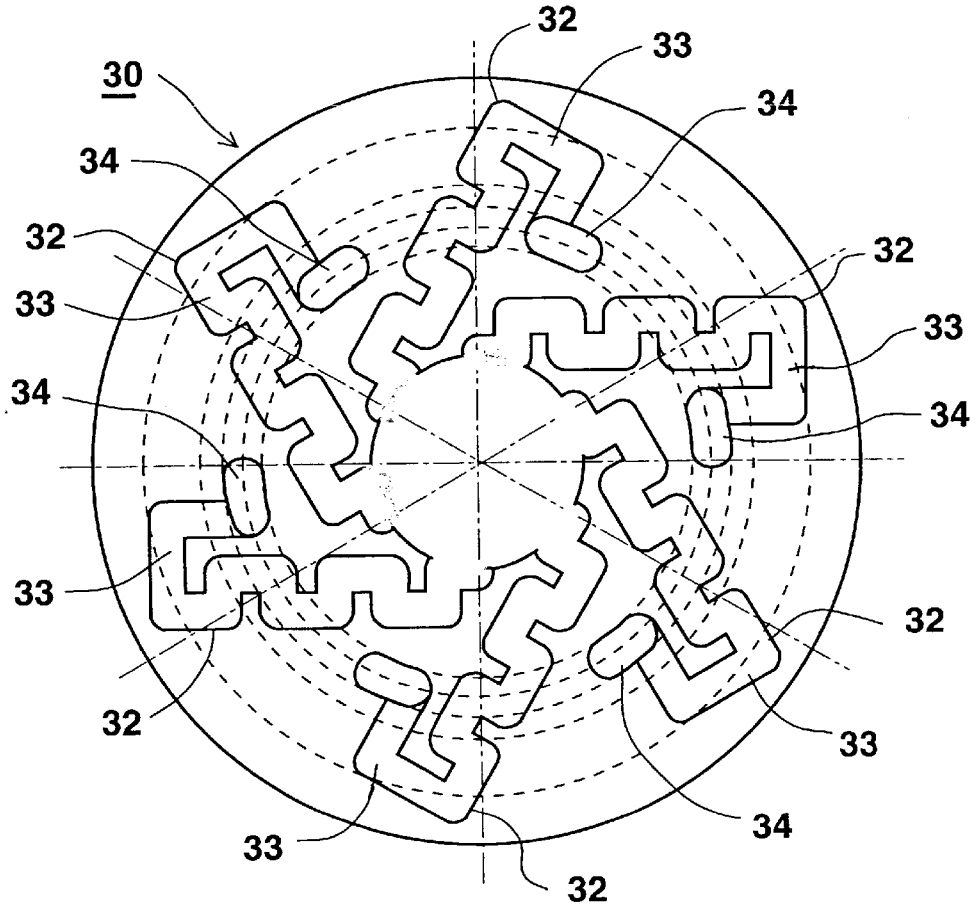

FIGS. 6 and 7 illustrate a second embodiment of the invention utilizing a different construction of a labyrinth disc. The labyrinth disc illustrated in FIGS. 6 and 7, and therein generally designated 30, is formed with a non-flat surface formation on its inlet face 30*a* defining a plurality of passageways 32 also extending mostly radially of the disc. Each passageway 32 includes a meandering recess 33, defining a radial flowpath, leading to a throughgoing hole 34 formed through the disc, defining an axial flowpath leading to the outlet face 30*b* of the disc and the mixing chamber (11, FIG. 1). Each of the meandering recesses 33 has an inlet end at a central area of disc 30, and an outlet end communicating with one of the throughgoing holes 34 through the disc. The holes 34 are disposed in a circular array outwardly of the central area of the disc. The surfaces of holes 34 ajacent to the outlet face 30*b* of disc 30 are also slanted inwardly, as shown at 34*a*, FIG. 6, to direct the water inwardly towards the center of the mixing chamber 11, and thereby to increase the quantity of air drawn into the chamber as well as to enhance the mixing thereof with the water, as described above.

An aerator including the labyrinth disc illustrated in FIGS. 6 and 7 operates in the same manner as described above with respect to FIGS. 1–5.

Figure 8:
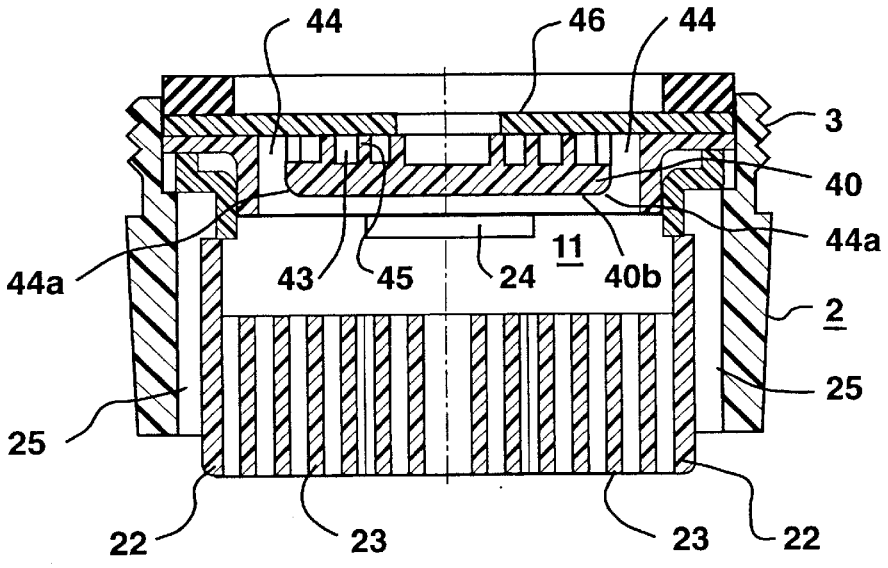
FIGS. 8, 9 and 10 are views corresponding to those of FIGS. 1, 2 and 3, respectively, illustrating a third form of labyrinth disc that may be used in the aerator of FIG. 1.
Figure 9:
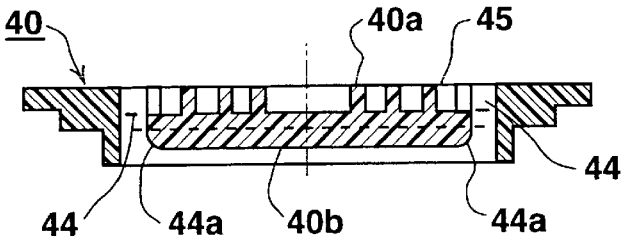
Figure 10:
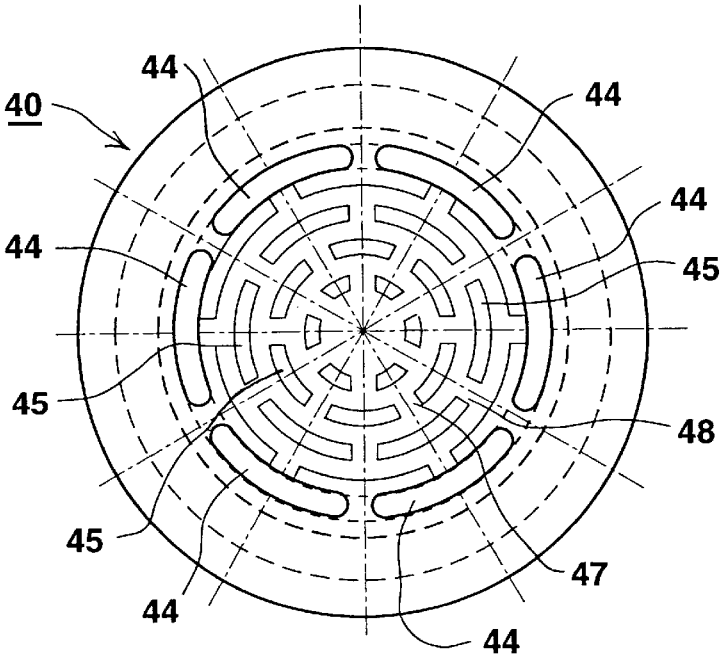

FIGS. 8–10 illustrate an aerator similar to that of FIGS. 1–5 but including a third construction of a labyrinth disc that may be used. The aerator illustrated in these figures is substantially the same as described above with respect to FIGS. 1–5, and therefore the same reference numerals have been used to identify corresponding parts, except for the construction of the labyrinth disc, which is therein designated 40.

The labyrinth disc 40 is also formed with a non-flat surface formation defining a plurality of labyrinth passageways 43 defining radial flowpaths in the inlet face 40*a* of the disc leading to a plurality of holes 44 formed through the disc, defining axial flowpaths leading into the mixing chamber 11. In this case, however, the radial flowpaths of the labyrinth passageways 43 are defined by a plurality of circular arrays of ribs 45 projecting from the inlet face 40*a* of the disc, and a flat annular closure disc 46 overlying and in contact with the outer faces of ribs 45. The ribs 45 as well as the axial flowpath holes 44 are all elongated and curved circumferentially of the labyrinth disc 40.

As in the above-described embodiments, the inner surface of the axial flowpaths (holes 44) are slanted inwardly, as shown at 44*a*, FIGS. 8 and 9, to direct the water inwardly towards the center of the mixing chamber 11, and thereby to increase the quantity of air drawn into the chamber, as well as the mixing of the air with the water in the chamber.

As seen particularly in FIG. 10, each circular array of ribs 45 is spaced from the adjacent circular array by a space 47, and each rib in a circular array is spaced from the next adjacent rib in the same array by another space 48. The ribs in the circular arrays are staggered, such that each rib 45 in one circular array is radially aligned with a space 48 in the adjacent array.

It will thus be seen that the water impinging the central region of the labyrinth disc 40 will travel via radial flowpaths defined by spaces 47 and 48 between the ribs, until they reach the throughgoing holes 44. These holes, which thus define axial flowpaths through the disc, are arranged in a circular array outwardly of the circular arrays of ribs 45. The resulting labyrinth passageways will therefore reduce the pressure within the mixing chamber causing it to draw air from the outside in the same manner as described above with respect to FIGS. 1–5.

FIG. 11 illustrates a variation in the construction of the labyrinth disc, thereby designated 50, wherein the radial flowpaths of the labyrinth passageways are defined by two circular arrays of ribs 51 in staggered relation to each other leading to the outlet holes 52 defining the axial flowpaths. FIG. 12 illustrates a further variation in the construction of the labyrinth disc 54, wherein there are three circular arrays of ribs 55 in staggered relation to each other leading to the outlet holes 56. FIG. 13 illustrates a further construction wherein the labyrinth passageways in the labyrinth disc 57 include radial flowpaths defined by two circular arrays of ribs 58 leading to the outlet holes 59 defining the axial flowpaths, in which the ribs are of generally triangular configuration, and the outlet holes are of circular configuration. FIG. 14 illustrates a still further construction in the labyrinth disc 60, wherein the radial flowpaths of the labyrinth passageways are defined by a plurality of radially-extending ribs 61 leading to the outlet holes 62.

Figure 15:
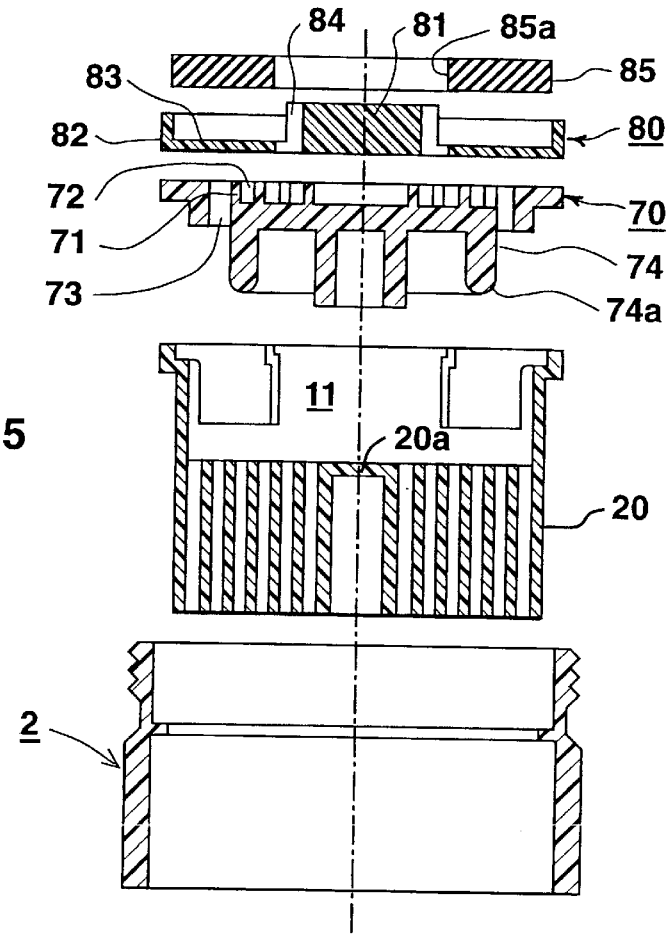
FIG. 15 is an exploded, sectional view illustrating another form of aerator constructed in accordance with the present invention.
Figure 16:
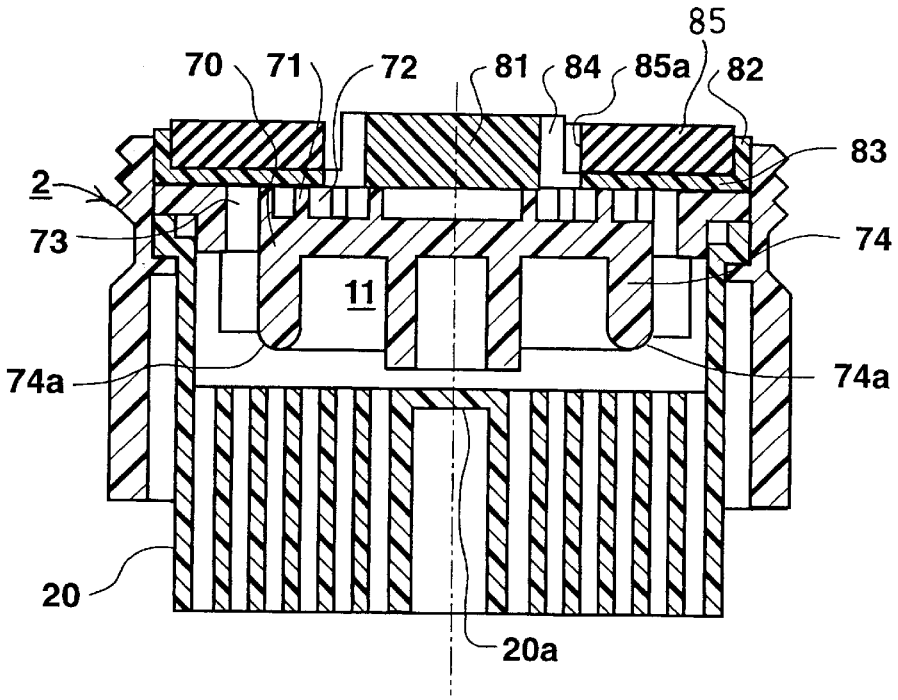
FIG. 16 is a sectional view of the aerator of FIG. 15 in assembled condition.

FIGS. 15–17 illustrate an aerator similar to that of FIGS. 8–10, including a housing, substantially the same as in that aerator and therefore correspondingly numbered 2, and a water guide member similar to that in FIGS. 8–10 and therefore correspondingly numbered 20, except that the center region of member 20 is closed by a wall 20*a* so that the water is discharged only in annular streams around the central region. In addition, the labyrinth disc, the closure disc, and the seal are of somewhat different construction.

Thus, the labyrinth disc, generally designated 70 in the aerator of FIGS. 15–17, includes a plurality of ribs 71, which may be of a similar configuration as in the aerator of FIGS. 8–10, defining a plurality of labyrinth passageways including radial flowpaths 72 leading to throughgoing holes 73. The outlet face of labyrinth disc 70, is formed with an annular wall 74 whose outer wall is aligned with the inner edges of holes 73 so as to direct the water passing through those holes into the mixing chamber 11. The lower surface of annular wall 74 is slanted inwardly (or rounded), as shown at 74*a*, to direct the water inwardly towards the center of the mixing chamber, thereby enhancing the quantity and mixing of the air with the water in that chamber as described above.

Closure disc 80, which engages the ribs 71 on the inlet face of the labyrinth disc 70, includes a solid cylindrical section 81 at its center, an annular rim 82 around its periphery, and a thin annular section 83 in between. A plurality of holes 84 are formed through the central cylindrical section 81 of the closure disc, with the centers of the holes substantially aligned with the juncture of the central cylindrical section 81 and the thin annular section 83 of the closure disc.

An elastomeric ring 85 serves as the seal and is applied over the thin annular section 83 of the closure disc such that the inner edge 85*a* of the ring just engages the outer surface of the central cylindrical section 81 of the closure disk.

The aerator illustrated in FIGS. 15–17 operates in the same manner, and provides the same advantages, as described above particularly with respect to FIGS. 8–10. However, it also has an additional advantage, in that it provides some regulation of the output in case of pressure variations in the water supply pressure. Thus, should the water supply pressure increase, ring 85 becomes compressed, thereby restricting the cross-sectional areas of the inlet passageways 84, and vice versa. Elastomeric ring 85 also performs the sealing function of the elastomeric rings in the previously-described embodiments.

FIGS. 18 and 19 illustrate an aerator very similar to that of FIGS. 15–17, except that instead of providing a single elastomeric ring (85) to perform both the regulating function and the sealing function, an inner elastomeric ring 87 is provided for the regulating function, and a separate outer elastomeric ring 88 is provided for the sealing function. In substantially all other respects, the construction and operation of the aerator of FIGS. 18 and 19 are the same as in the aerator of FIGS. 15–17.

In all the previously-described embodiments, the water guide member (e.g., 20) was one which included a plurality of concentric tubes, such that the water was discharged in the form of a plurality of concentric annular streams of soft aerated water.

FIGS. 20 and 21 illustrate a water guide member, therein designated 90, of similar construction as in FIGS. 15 and 16, for example, but formed with a plurality of circular arrays of water discharge passageways 91–93 each of circular cross-section. The passageways in the outer circular array 91 are of largest diameter, those of the intermediate circular array 92 are of slightly smaller diameter, and those of the inner circular array 93 are of smallest diameter. The passageways in the three circular arrays are in a staggered relationship, with the passageways in one array aligned with the spaces between passageways in the adjacent array or arrays.

FIG. 22 illustrates a water guide member, therein designated 95, of similar construction as that in FIGS. 20 and 21, except that the water guide member 95 is constituted of a body of honeycomb construction formed with a plurality of parallel passageways extending axially through the body.

While the invention has been described with respect to several preferred embodiments, it will be appreciated that these are set forth merely for purposes of example, and that many other variations, modifications and applications of the invention may be made.

I claim:

1. An aerator for attachment to a water tap, comprising:

a housing having an inlet attachable to the water tap for receiving water therefrom, and an outlet through which the water is discharged;

a labyrinth disc carried by said housing and having an inlet face facing the housing inlet, an outlet face facing the housing outlet, and a plurality of labyrinth passageways leading from said inlet face to said outlet face for reducing the water pressure at the outlet face of the labyrinth disc;

each of said plurality of labyrinth passageways including a radial flowpath extending in the radial direction of the housing for a major part of the length of the respective passageway, and an axial flowpath directly connected to said radial flowpath in the respective passageway and extending in the axial direction of the housing for a minor part of the length of the respective passageway;

a water-air mixing chamber at the outlet face of the labyrinth disc;

and an air passageway leading from externally of the housing to said mixing chamber for drawing air into the mixing chamber for mixing with the water therein;

said radial flowpaths extending radially from a first area on the inlet face of the disc facing the housing inlet to a second area thereon;

said axial flowpaths extending axially through the disc at said second area thereof to the outlet face of the disc;

said radial flowpaths being defined by a non-flat surface formation on said inlet face of the disc, and a flat closure disc overlying and in contact with said non-flat surface formation;

said closure disc being formed with a circular array of inlet holes therethrough leading from its inlet face facing the housing inlet into said labyrinth passageways, and including an elastomeric ring over the inlet face of the closure disc partially overlying said inlet holes and deformable such as to decrease their effective cross-sectional areas with increasing water inlet pressure.

2. The aerator according to claim 1, wherein said radial flowpaths are defined by straight recesses formed in said inlet face of the disc, and said axial flowpaths are edge slots formed in the outer edge of the disc.

3. The aerator according to claim 1, wherein said non-flat surface formation includes a plurality of recesses formed in the inlet face of the labyrinth disc and extending radially thereof.

4. The aerator according to claim 1, wherein said axial flowpaths are holes formed through said labyrinth disc.

5. An aerator for attachment to a water tap, comprising:

a housing having an inlet attachable to the water tap for receiving water therefrom, and an outlet through which the water is discharged;

a labyrinth disc carried by said housing and having an inlet face facing the housing inlet, an outlet face facing the housing outlet, and a plurality of labyrinth passageways leading from said inlet face to said outlet face for reducing the water pressure at the outlet face of the labyrinth disc;

each of said plurality of labyrinth passageways including a radial flowpath extending in the radial direction of the housing for a major part of the length of the respective passageway, and an axial flowpath directly connected to said radial flowpath in the respective passageway and extending in the axial direction of the housing for a minor part of the length of the respective passageway;

a water-air mixing chamber at the outlet face of the labyrinth device disc;

and an air passageway leading from externally of the housing to said mixing chamber for drawing air into the mixing chamber for mixing with the water therein;

said radial flowpaths extending radially from a first area on the inlet face of the disc facing the housing inlet to a second area thereon;

said axial flowpaths extending axially through the disc at said second area thereof to the outlet face of the disc;

said radial flowpaths being defined by a non-flat surface formation on said inlet face of the disc, and a flat closure disc overlying and in contact with said non-flat surface formation;

said axial flowpaths leading to the outlet face of the labyrinth disc including surfaces slanted inwardly towards the center of the labyrinth disc to direct the water inwardly towards the center of the mixing chamber.

6. The aerator according to claim 5, wherein said non-flat surface formation includes a plurality of ribs formed on the inlet face of the labyrinth disc and defining with said closure disc meandering passageways extending radially of the labyrinth disc.

7. The aerator according to claim 6, wherein said plurality of ribs are disposed in a plurality of concentric circular arrays in which the ribs of each circular array are in staggered relation with respect to the ribs of each adjacent circular array.

8. The aerator according to claim 5, further including water guides in the form of a plurality of spaced concentric tubes at the housing outlet extending parallel to the axis of the housing outlet and directing the aerated water to flow parallel to said axis.

9. The aerator according to claim 5, further including a water guide member in the form of a body having a plurality of parallel, laterally spaced passageways therethrough.

10. An aerator for attachment to a water tap, comprising:

a housing having an inlet attachable to the water tap for receiving water therefrom, and an outlet through which the water is discharged;

a labyrinth disc carried by said housing and having an inlet face facing the housing inlet, an outlet face facing the housing outlet, and a plurality of labyrinth passageways leading from the inlet face to the outlet face for reducing the water pressure at the outlet face of the labyrinth disc;

a water-air mixing chamber at the outlet face of the labyrinth disc;

said labyrinth passageways leading to the outlet face of the labyrinth disc including surfaces slanted inwardly towards the center of the labyrinth disc to direct the water inwardly towards the center of the mixing chamber;

an air passageway leading from externally of the housing to the water-air mixing chamber for drawing air into the mixing chamber for mixing with the water therein; and water guides at said housing extending parallel to the axis of the housing and directing the aerated water to flow parallel to said axis.

11. The aerator according to claim 10, wherein said labyrinth passageways include radial flowpaths extending from a first area on the inlet face of the disc facing the housing inlet to a second area thereof, and axial flowpaths extending through the disc at said second area thereof and formed with said slanted surfaces leading to the outlet face of said disc.

12. The aerator according to claim 11, wherein said radial flowpaths are defined by a non-flat surface formation on said inlet face of the labyrinth disc, and a flat closure disc overlying and in contact with said non-flat surface formation.

13. The aerator according to claim 12, wherein said closure disc is formed with a circular array of holes therethrough leading to said mixing chamber, and includes an elastomeric ring partially overlying said holes and deformable such as to decrease their effective cross-sectional areas with increasing water inlet pressure.

14. The aerator according to claim 12, wherein said non-flat surface formation includes a plurality of recesses formed on, and extending radially of, the inlet face of the labyrinth disc.

15. The aerator according to claim 14, wherein said non-flat surface formation includes a plurality of ribs formed on the inlet face of the labyrinth disc and defining with said closure disc said radial flowpaths extending radially of the labyrinth disc.

16. An aerator for attachment to a water tap, comprising:

a housing having an inlet attachable to the water tap for receiving water therefrom, and an outlet through which the water is discharged;

a water-air mixing chamber receiving the inletted water;

an air passageway leading from externally of the housing to said mixing chamber for drawing air into the mixing chamber and for mixing it with the water therein;

a disc interposed between said housing inlet and said mixing chamber and formed with a circular array of holes therethrough leading to said mixing chamber;

an elastomeric ring partially overlying said holes and deformable such as to decrease their effective cross-sectional areas with increasing water inlet pressure;

and a water-splitting, pressure-reducing body between said disc and said mixing chamber and defining a plurality of labyrinth passageways which include radial flowpaths extending from a first area on the inlet face of said body facing the housing inlet to a second area thereof, and axial flowpaths extending through said body at said second area thereof leading to said mixing chamber.

* * * * *